US005163860A

United States Patent [19]

Clark

[11] Patent Number: 5,163,860

[45] Date of Patent: Nov. 17, 1992

[54] TOW SYSTEM FOR WATER BOARD

[75] Inventor: Brian Clark, Bothell, Wash.

[73] Assignee: O'Brien International, Inc., Redmond, Wash.

[21] Appl. No.: 750,205

[22] Filed: Aug. 27, 1991

[51] Int. Cl.[5] ..... B63B 1/00

[52] U.S. Cl. ..... 441/65; 114/253

[58] Field of Search ..... 114/253; 441/65–69, 441/71

[56] References Cited

U.S. PATENT DOCUMENTS

| | | | |
|---|---|---|---|
| 3,027,574 | 4/1962 | Meehan | 441/65 |
| 3,147,498 | 9/1964 | Convis | 441/65 |
| 3,352,275 | 11/1967 | Wilson | 441/65 |
| 3,380,425 | 4/1968 | Wilson | 114/253 |
| 3,561,025 | 2/1971 | Teach | 441/65 |
| 3,807,342 | 4/1974 | Turner | 441/65 |
| 3,952,354 | 4/1976 | Turner | 114/253 |
| 4,678,444 | 7/1987 | Monreal | 441/65 |
| 4,756,700 | 7/1988 | Coleman | 441/65 |
| 5,083,955 | 1/1992 | Echols | 114/253 |

*Primary Examiner*—Edwin L. Swinehart

[57] ABSTRACT

A water board is provided with a recess in its top surface for holding a tow rope handle as the board is being towed. The recess includes a pair of transversely extending handle portions and a central hand portion between the handle portions for permitting the user's hand to grasp a handle which is positioned in the handle portions. The recess also includes a pair of angled portions which converge forwardly from the handle portion for accommodating a tow rope bridle.

8 Claims, 3 Drawing Sheets

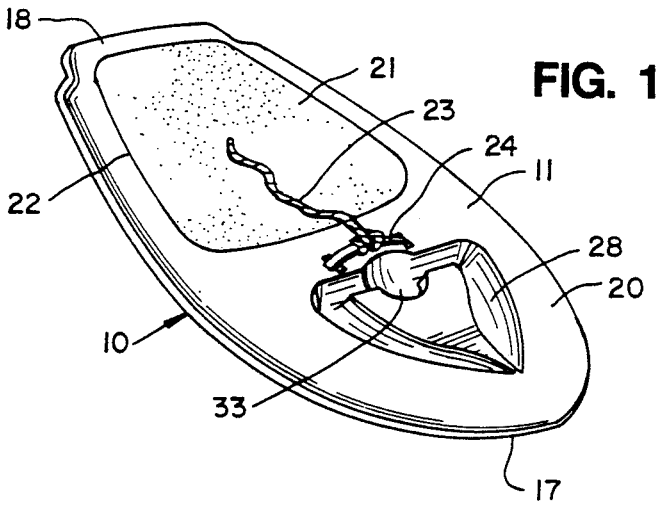
FIG. 1
FIG. 2
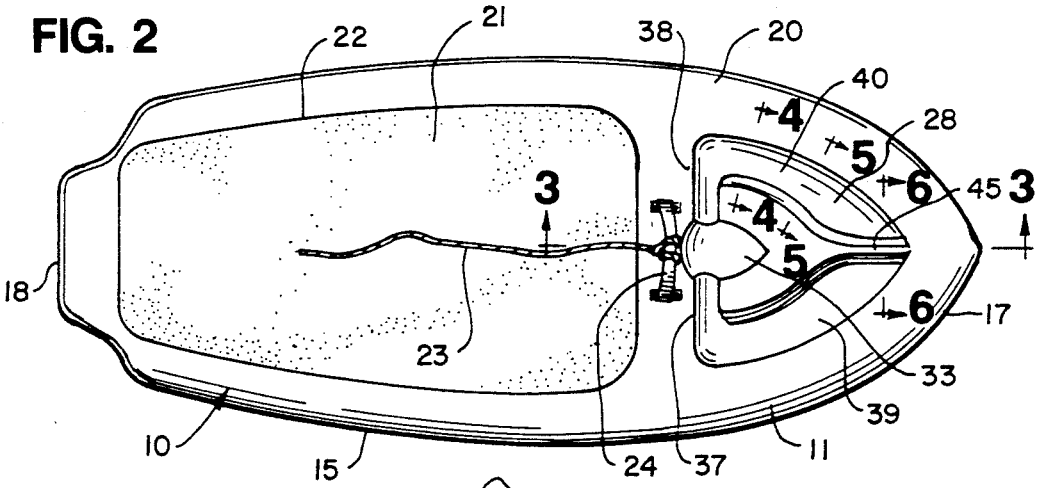
FIG. 7
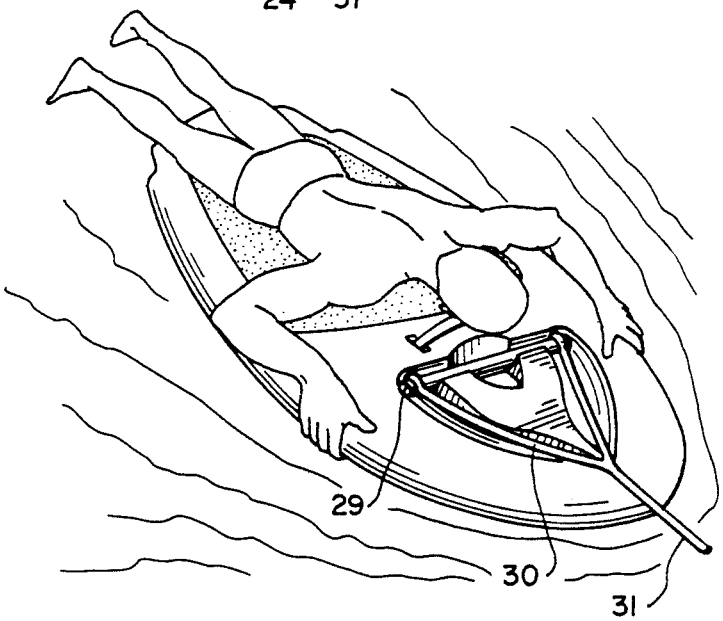

FIG. 3
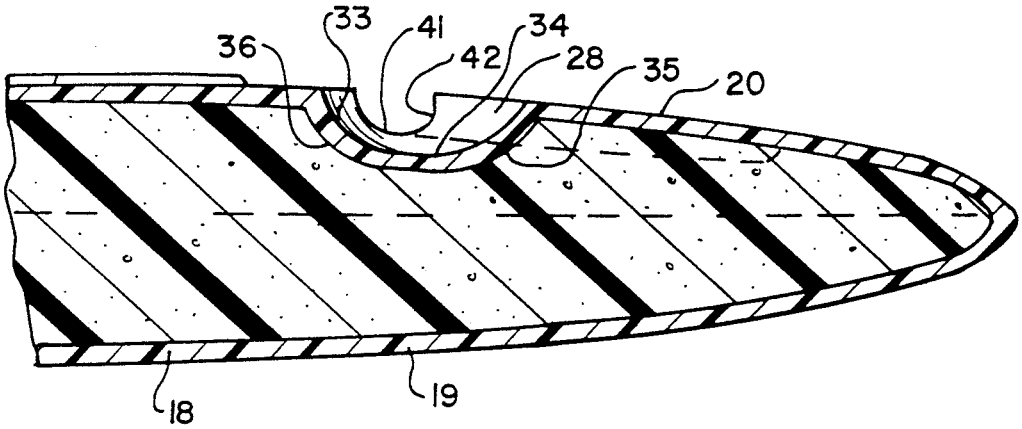
FIG. 4
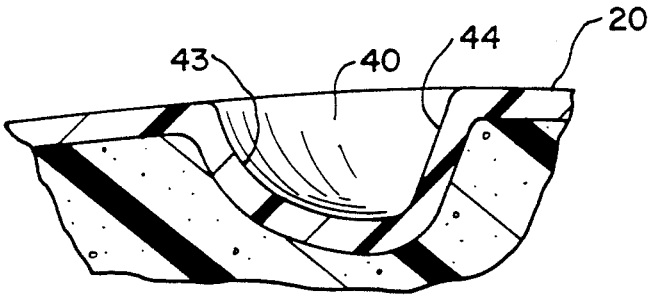
FIG. 5
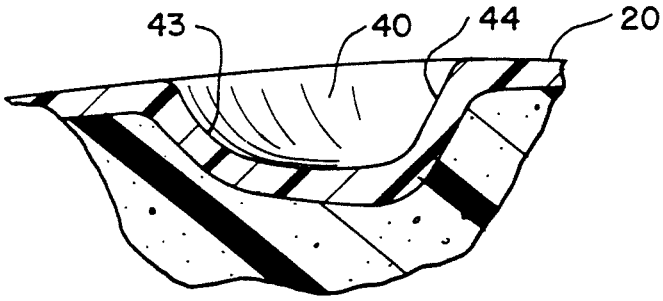
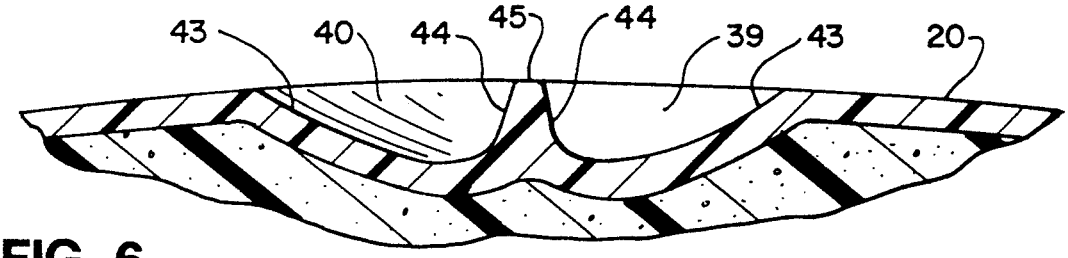
FIG. 6

TOW SYSTEM FOR WATER BOARD

BACKGROUND

This invention relates to water boards, and, more particularly, to a tow system for a water board which is provided by a recess in the top surface of the knee board for removably holding a tow rope handle.

The term "water board" may be applied generally to knee boards, surf boards, and other devices which are designed to ride or plane on water. A surf board is approximately six feet long, and the user generally stands on the board while riding waves. A knee board is similar to a surf board but shorter. The user kneels rather than stands on the board. The user holds onto a tow rope with his legs strapped to the knee board, and the user is pulled over water by a power boat.

A knee board was initially considered as an alternative to water skis which could be enjoyed without significant training or experience. However, many knee board users have difficulty in performing the maneuvers which are necessary in order to attain the kneeling position as the knee board is towed.

With a conventional knee board, the user first lies prone on top of the knee board while holding onto the board with one hand and the tow rope with the other hand. As the knee board is towed through the water, the user pulls himself into a kneeling position on top of the board while simultaneously holding onto the tow rope and then adjusts the knee strap over his thighs while continuing to hold the tow rope. These maneuvers are very difficult for many people to perform and have limited the market for knee boards.

SUMMARY OF THE INVENTION

The invention provides a water board which greatly facilitates the starting procedure by providing a recess in the top surface of the board for holding a tow rope handle. The user may therefore lie prone on the board and grip the board with both hands as the towing operation begins. As the towing speed increases, the user may either remain prone, pull himself into a kneeling position, or rise to a standing position without worrying about holding the tow rope. The user can also hold onto the tow rope while in the kneeling position o the standing position. While kneeling, the user grasps the tow rope handle with one hand and lifts the handle out of the recess while holding the board with the other hand. The user can either remain kneeling or rise to a standing position.

DESCRIPTION OF THE DRAWING

The invention will be explained in conjunction with an illustrative embodiment shown in the accompanying drawing, in which:

FIG. 1 is a perspective view of a water board formed in accordance with the invention;

FIG. 2 is a top plan view of the water board;

FIG. 3 is a fragmentary sectional view taken along the line 3—3 of FIG. 2;

FIG. 4 is a fragmentary sectional view taken along the line 4—4 of FIG. 2;

FIG. 5 is a fragmentary sectional view taken along the line 5—5 of FIG. 2;

FIG. 6 is a fragmentary sectional view taken along the line 6—6 of FIG. 2;

FIG. 7 is a perspective view showing the user of the board lying prone on the board during the initial stages of the towing operation;

DESCRIPTION OF SPECIFIC EMBODIMENT

Figure 8:
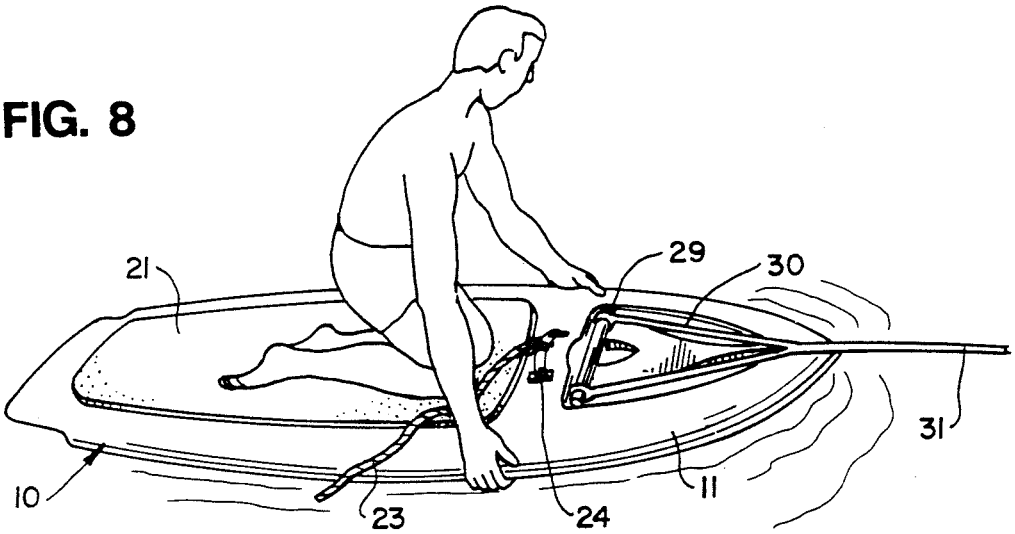
FIG. 8 is a perspective view showing the user kneeling on the board while holding onto the board with both hands.

A water board 10 includes an elongated body 11 which may be constructed in a number of ways which are well known in the kneeboard industry, e.g., through plastic rotational molding, foam and fiberglass fabrication, or vacuum forming. The particular board illustrated is slightly longer than a conventional knee board and may be referred to as a freeboard. However, the invention can be used with any type of water board, including knee boards, surf boards, ski boards, etc.

The body 11 has a tapered front end 17 and a somewhat blunter rear end 18. The elongated body has a bottom surface 19, which may be provided with conventional strakes or grooves to facilitate planing on the water or directional stability, and a top surface 20. A soft traction pad 21 is positioned within a recess 22 in the top surface 20.

A leash 23 is attached to a bracket 24 on the top shell 12. The leash can be used for carrying the board on land or for balance on the water, in which case the user can hold onto the leash when kneeling or sitting on the board.

A recess 28 is provided in the top surface 20 adjacent the front end 17. The recess is generally triangularly shaped and is configured to hold a conventional tow rope handle 29 and a tow rope bridle 30 which are attached to a tow rope 31.

The recess 28 includes a central hand cavity or depression 33 which is provided by a generally flat bottom surface 34 (FIG. 3) which extends generally parallel to the bottom and top surfaces 19 and 20, front and rear walls 35 and 36 which curve upwardly to the top surface 20, and side walls 37 and 38.

The recess 28 also includes a pair of handle portions 37 and 38 which extend laterally from the central hand portion 33 of the recess generally perpendicularly to the longitudinal centerline of the board and a pair of angled portions 39 and 40 which extend forwardly from the handle portions 37 and 38 and converge toward the longitudinal centerline of the board adjacent the front end of the board. Referring to FIG. 3, each of the two transversely extending handle portions 37 and 38 are generally U-shaped in cross section and is defined by a generally U-shaped surface 41 which includes a flat front portion 42 which extends generally perpendicularly to the plane of the board.

Referring to FIGS. 4–6, the angled portions 39 and 40 of the recess are somewhat V-shaped in cross section, and the depth of the angled portions gradually decreases toward the front end of the board. Each angled portion includes an outer side surface 43 which slopes gently downwardly from the top surface of the board and an inner side surface 44 which extends at a sharper angle with respect to the top surface. The two angled portions are separated by a narrow ridge 45 at the forward end of the recess.

Referring to FIG. 7, the rider begins the towing operation by placing a tow rope handle 29 into the transversely extending recesses 37 and 38, and the two legs of the tow rope bridle 30 lie in the angled portions 39 and 40 of the recess. The tow rope handle butts against the upwardly extending, generally flat front surfaces 42 of the transverse recesses 37 and 38, and a towing force can be exerted on the tow rope handle by the tow rope 31 without pulling the handle out of the transverse recesses. The rider lies prone on the top surface of the board and grips both sides of the board as illustrated in FIG. 7 as the power boat begins the towing operation.

The particular board illustrated will plane at about 2 miles per hour, and it is not necessary to tow the board at high speeds. As the board is being towed, the rider may either remain prone or may pull himself into a kneeling position as illustrated in FIG. 8. The rider may either hold onto the board with both hands or may hold onto the leash 23. The rider can also sit on the board while holding the leash. The rider can also rise to a standing position and use the board like a surf board while the tow rope handle remains in the recess.

Figure 9:
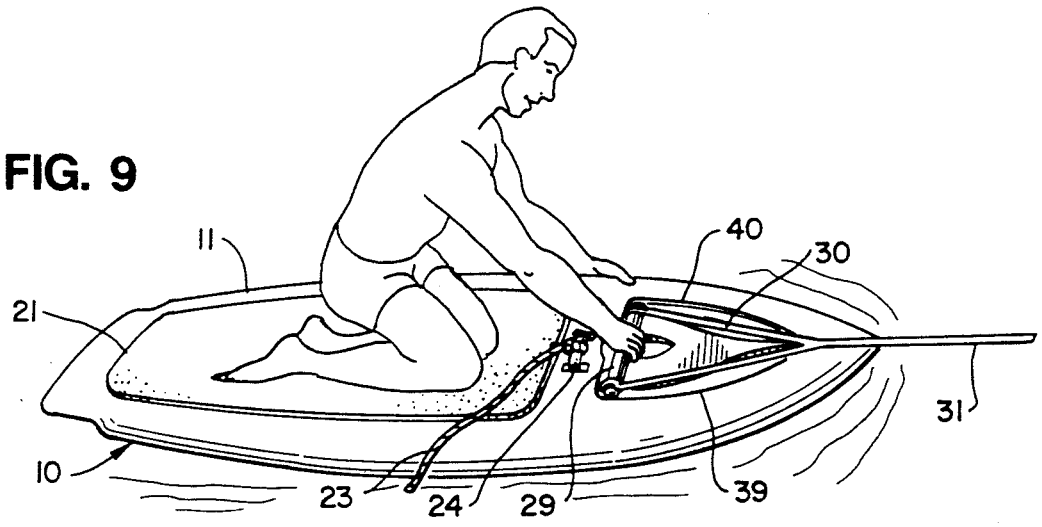
FIG. 9 illustrates the user grasping the tow rope handle before lifting the tow rope handle out of the recess.
Figure 10:
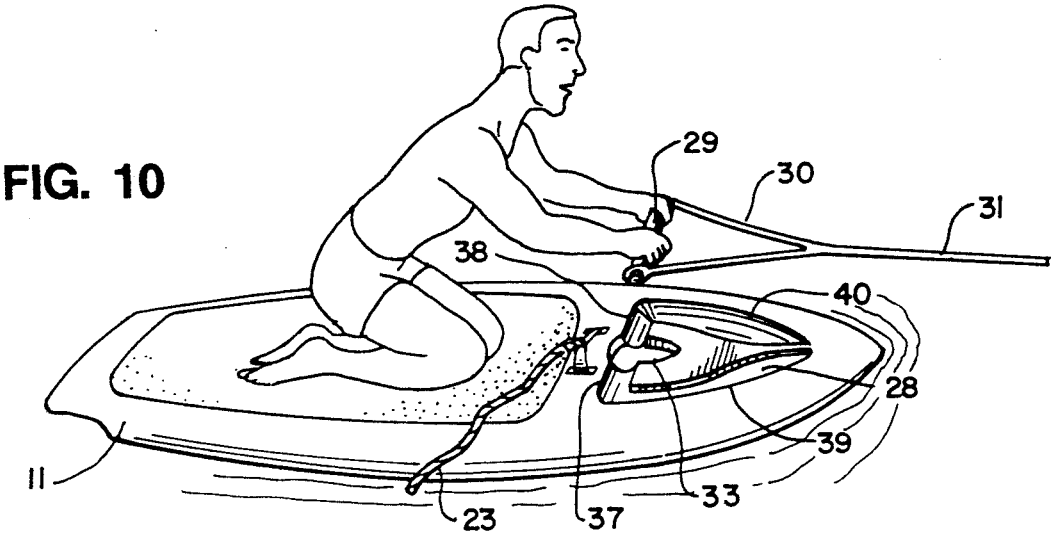
FIG. 10 illustrates the user holding onto the tow rope handle with both hands.

The rider can exert more control on the board by holding the tow rope. While holding onto the board with one hand, the rider grasps the tow rope handle with his free hand as illustrated in FIG. 9. As can be seen in FIG. 3, the bottom surface 34 of the central hand portion 33 of the recess extends below the bottom of the transverse recesses 37 and 38, and the rider's fingers can encircle the tow rope handle within the central recess 33. The rider withdraws the handle from the transverse recesses and then grasps the tow rope handle with both hands as illustrated in FIG. 10. The rider can then direct the board to move outside of the boat's wake or can perform tricks. The rider can also rise to a standing position while holding the tow rope.

The board is manufactured in a manner similar to conventional knee boards, e.g., rotation molding, which provides a one piece board. The towing recess can be formed in the board during the molding operation, and no separate manufacturing operations for the recess are required. Furthermore, since the recess extends downwardly below the top surface of the board, the towing system does not require any projections above the top surface which could be hazardous. The flat front surfaces 42 of the transverse recesses 37 and 38 provide positive stops for the tow rope handle to permit the board to be towed without causing the handle to be withdrawn from the recess. Further, the smoothly sloping outer side walls 43 of the angled portions 39 and 40 of the recess permit the two legs of the tow rope bridle 30 to move laterally relative to the longitudinal centerline of the board without interference if the power boat changes direction.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A water board comprising an elongated body having top and bottom surfaces and front and rear end portions, the top surface being provided with a downwardly extending generally Y-shaped recess in the front end portion, the recess including:

a) a central hand portion for accommodating a hand of a user of the board;

b) a pair of handle portions which extend laterally outwardly from the central hand portion for accommodating a tow rope handle, each of the handle portions of the recess being generally U-shaped in cross section and including a forward wall portion which provides a stop surface for a tow rope handle, the hand portion of the recess being deeper than the handle portions of the recess whereby a user's hand can extend around a tow rope handle in the handle portions of the recess; and c) a pair of angled portions which converge forwardly and inwardly toward each other from the handle portions and which extend laterally inwardly beyond the outer ends of the stop surfaces of the handle portions for accommodating a Y-shaped tow rope bridle.

2. The water board of claim 1 in which the angled portions of the recess include forward end portions which are separated by a narrow ridge.

3. The water board of claim 1 in which each of the angled portions is generally V-shaped in cross-section and includes an outer side surface which slopes downwardly from the top surface of the water board.

4. The water board of claim 3 in which each of the angled portions includes an inner side surface which extends downwardly from the top surface of the water board, the inner side surface forming an angle with the top surface which is grater than the angle between the outer side surface of the angled portion and the top surface.

5. The water board of claim 4 in which the depth of the angled portions of the recess gradually decreases toward the front end of the water board.

6. The water board of claim 1 in which the depth of the angled portions of the recess gradually decreases toward the front end of the water board.

7. The water board of claim 1 in which the central hand portion of the recess includes a bottom wall which is positioned below the U-shaped handle portions of the recess.

8. The water board of claim 1 in which the central hand portion extends forwardly and rearwardly beyond the U-shaped handle portions.

* * * * *